United States Patent [19]

Banks

[11] Patent Number: 4,493,515

[45] Date of Patent: Jan. 15, 1985

[54] MULTIPLE ELECTRICAL OUTLET STRIP CONSTRUCTION

[75] Inventor: Charles A. Banks, Westville, N.J.

[73] Assignee: SL Industries, Inc., Marlton, N.J.

[21] Appl. No.: 368,762

[22] Filed: Apr. 15, 1982

[51] Int. Cl.[3] ..... H01R 9/00

[52] U.S. Cl. ..... 339/14 L; 29/860; 339/139 R; 339/164 M

[58] Field of Search ..... 339/14 L, 14 R, 139 R, 339/164 R, 164 M; 29/860, 871

[56] References Cited

U.S. PATENT DOCUMENTS

| | | | |
|---|---|---|---|
| 1,956,320 | 4/1934 | Elwell | 339/139 R |
| 2,001,990 | 5/1935 | Tregoning | 339/164 R |
| 2,626,973 | 1/1953 | Dutra | 339/14 L |
| 4,072,401 | 2/1978 | Instone | 339/125 R |
| 4,113,334 | 9/1978 | Instone | 339/22 R |

*Primary Examiner*—Z. R. Bilinsky

*Attorney, Agent, or Firm*—Cushman, Darby & Cushman

[57] ABSTRACT

A cased electrical component, such as a multiple electrical outlet strip, has a greatly simplified construction. A single structure provides for passage of an electrical cord through the metal casing and grounding of the electrical component within the casing to the casing. The casing over and base are attached together with a simple snap-action provided by interfering projections and openings formed on cooperating portions of the base and cover. Temporary mounting openings are formed directly in the base, and a stiff sheet of plastic material is disposed between the base and the electrical component to prevent access to the electrical component through the temporary mounting openings.

8 Claims, 6 Drawing Figures

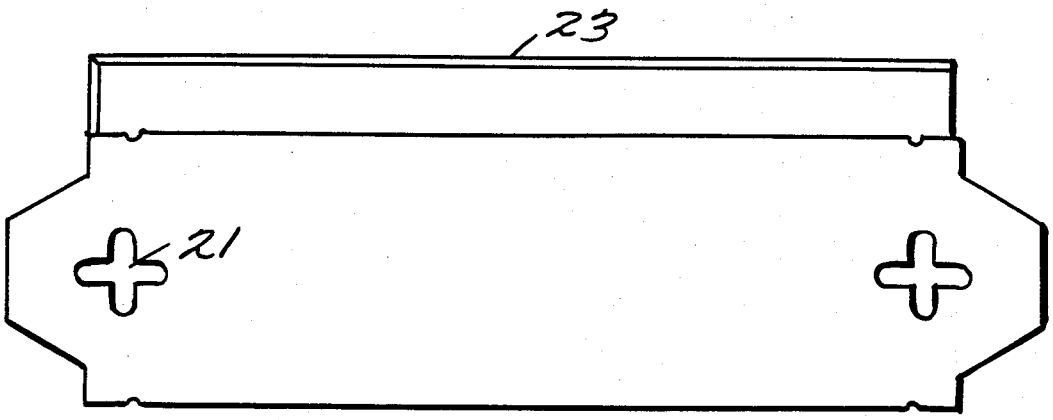
Fig. 5.
Fig. 3.
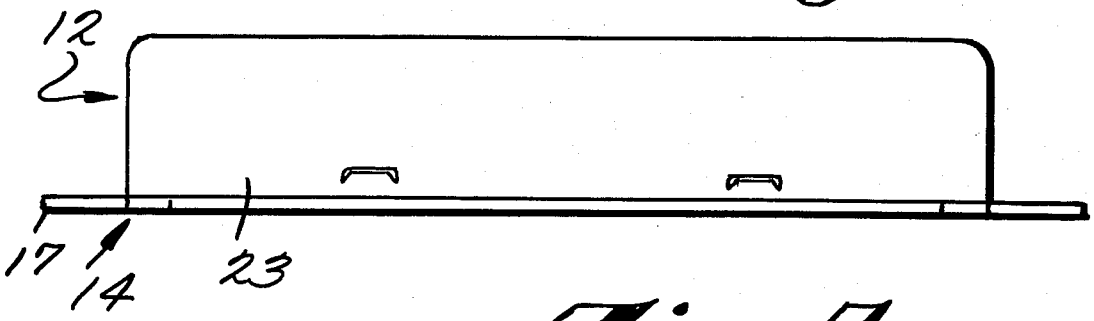
Fig. 4.
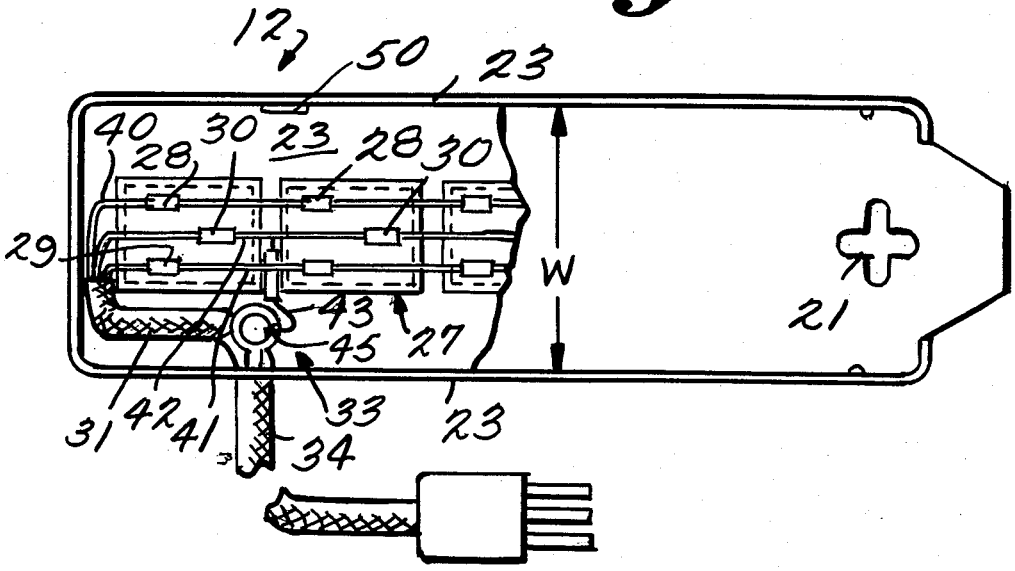

MULTIPLE ELECTRICAL OUTLET STRIP CONSTRUCTION

BACKGROUND AND SUMMARY OF THE INVENTION

In the construction of cased electrical components, such as multiple electrical outlet strips, it is desirable to provide as simple a construction, utilizing the simplest manufacturing techniques, as possible, while not sacrificing safety or quality. Advances have been made in the art to this end, as exemplified by the structures in U.S. Pat. Nos. 4,072,401 and 4,113,334, wherein multiple electrical outlet strips are provided that are relatively simple and inexpensive to construct yet provide all desired functions. According to the present invention the construction of cased electrical components, such as multiple electrical outlet strips, is provided which achieves even greater simplicity and cost reductions than are achieved with the structures and procedures disclosed in the above-identified patents.

In prior art constructions of multiple electrical outlet strips utilizing metal casings, grounding of the electrical component or components to the metal casing has been effected in a relatively complicated manner. Normally a stud or flange is formed, and is soldered or welded to the metal casing, and a ground wire is then led from the electrical component or components to the stud or flange. According to the present invention the separate operations associated with forming or welding or soldering the stud or flange are eliminated. A grounding tab is formed integrally with the casing during the operation of punching the opening through which the electrical cord will extend into the casing. The tab is bent over when the electrical cord is inserted into the casing, and the ground wire may be soldered directly to the tab. This results in reduced material costs as well as substantial ease of manufacture.

Conventionally the cover and base components of multiple electrical outlet strip casing are connected together by bending over cooperating tab portions on extending ears, or by pop riveting the components together when the cover and/or the base do not have an ear. According to the persent invention the cover and base are connected together in a manner much simpler than either of these two prior art arrangements, and with reduced material costs, neither a pair of ears nor pop rivets being necessary. Attachment of the casing pieces together according to the present invention is accomplished by forming snap-connection means integrally with both the cover and base. For instance, a plurality of openings are provided in opposite side edges upstanding from the base, and integral projections are formed in opposed cover side walls by deforming portions thereof. The projections and openings readily snapped together and provide a tight interference fit. In this way ease of manufacture and assembly is facilitated, disassembly is possible, and at the same time the necessary tight interengagement between the cover and base is maintained.

According to the present invention temporary mounting openings are provided for the cased electrical component in an advantageous way compared to the prior art. Typically in the prior art accessory metal "hats" with shelf portions having temporary mounting openings formed therein are welded or otherwise affixed to the base of the casing. According to the present invention the necessity for such accessory components is eliminated by forming the temporary mounting openings (typically having a cruciform construction) directly in the casing base. In order to prevent penetration of mounting screws, or other mounting components, through the temporary mounting openings into contact with the electrical components mounted within the casing, a stiff piece of electrical insulating material, such as LEXAN, is provided between the base and the electrical components. The LEXAN sheet may merely be inserted into the casing during assembly, there being no necessity for affixing it to either casing piece, the sheet preferably being dimensioned so that an interference-type fit is provided between it and casing cover.

A cased electrical component according to the present invention has greatly simplified construction, and is substantially less expensive, than prior art cased electrical components having the same functionality. It is the primary object of the present invention to provide for the simplified construction of a cased electrical component while not sacrificing functionality. This and other objects of the invention will become clear from an inspection of the detailed description of the invention and from the appended claims.

BRIEF DESCRIPTION OF THE DRAWINGS

FIG. 3 is a side view, of the opposite side viewed in FIG. 2, of the casing components shown in assembled relationship;

FIG. 4 is a bottom plan view of the cover casing component of a portion of the multiple electrical outlet strip of FIG. 1, showing the interconnections between the electrical cord and grounding tab and outlet receptacles mounted by the casing;

FIG. 5 is a bottom perspective view of the base piece of the casing, with a stiff plastic insulating sheet shown in the background.

DETAILED DESCRIPTION OF THE DRAWINGS

Figure 1:
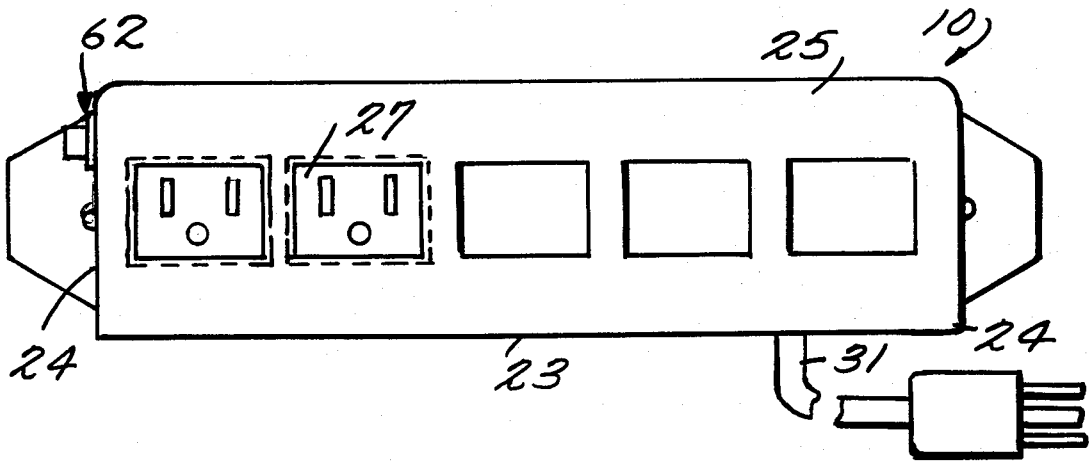
FIG. 1 is a top plan view of an exemplary multiple electrical outlet strip according to the present invention, with only one outlet receptacle shown mounted in place for clarity of illustration.

A cased electrical component according to the present invention is shown generally by reference numeral 10 in the drawings. Preferably the component 10 is a multiple electrical outlet strip, as described in U.S. Pat. Nos. 4,072,401 and 4,113,334, and the invention will be described in detail with respect to a multiple electrical outlet strip. However it is to be understood that the invention has broader applicability and the teachings thereof are utilizable in other cased electrical components.

The outlet strip 10 according to the present invention comprises a casing having two pieces, a cover 12 and a base 14. The base 14 comprises a substantially planar elongated body portion 15 having a pair of side edges 16 extending upwardly from opposite sides thereof and elongated in the same dimension of elongation A as the body 15 (see FIGS. 2 and 5 in particular). Ears 17 may be provided at either end of the body 15, which ears are adapted to overlap the cover 12. The edges 16 are substantially parallel to each other and the spacing between the external faces thereof is a distance W. While the side edges 16 are illustrated as continuous along the entire length of the body 15 in FIGS. 2 and 5, under some circumstances if desired they can be made discontinuous. A plurality of openings 19 are provided in each of the side edges, the openings preferably having a rectangular shape as illustrated in the drawings.

To facilitate mounting of the outlet strip 10, one or more temporary mounting openings 21 (see FIG. 5) are formed directly in the metal body 15, as by punching out the openings. The term "temporary mounting opening" as used in the present specification and claims means an opening adapted to receive a component attached to some surface on which the electrical outlet strip 10 is to be mounted, such as a screw. While a cruciform construction, as illustrated in FIG. 5, is preferred, the temporary mounting opening may have other forms such as spaced openings elongated in different dimensions.

The cover piece 12 of the casing of the multiple electrical outlet strip 10 comprises a plurality of side walls 23, 24, defining an interior volume V. A top face 25 has a plurality of outlet receptacle-receiving openings 26 punched therein, and the bottom of the cover 12 is open (see FIG. 4). A typical outlet receptacle is illustrated generally by reference numeral 27 (see FIGS. 1 and 4), and includes live, neutral, and ground receiving openings (see FIG. 1), cooperating respectively with terminals 28, 29, and 30 (see FIG. 4). An exemplary outlet receptacle utilizable with the multiple electrical outlet strip 10 is the type shown in U.S. Pat. No. 4,113,334.

The side walls 23 of the cover 12 are substantially parallel to each other, and have an internal spacing therebetween slightly greater than the distance W (see FIG. 4). One of the side walls 23, 24 also comprises means for defining an electrical cord 31-receiving opening therein, the particular opening according to the present invention being illustrated generally by reference numeral 32 in FIG. 2, and shown in association with one of the walls 23, although any of the side walls (or even the top 25) may be define the opening 32. According to the present invention means are provided for simultaneously providing passage of the electrical cord 31 through the casing and providing grounding of the electrical components (e.g. outlet receptacles 27) within the casing. This is provided according to the invention by the tab means shown generally by reference numeral 33 in FIGS. 2 and 4.

The tab means 33 include a thinned body portion 34 integral at one end thereof with the metal cover side wall 23, and having a free enlarged second end 35 thereof. Preferably an opening 36 is formed in the enlarged second end 35. The tab 33 extends into the opening 32, and prior to, or during, insertion of the electrical cord 31 into the cover 12, tab 33 is bent down to a position wherein the body 34 and second end 35 are substantially parallel to the top 25 of the cover 12 (see FIGURE 4). Thus the grounding tab and the cord-receiving opening may be formed in the same operation—that is they may be punched at the same time with the same tool—and there is no necessity for utilizing extra material for the grounding tab, the grounding tab being provided by an integral portion of the cover 12.

The manner in which electrical connections are made in the receptacle 10 is illustrated in FIG. 4. The hot, neutral, and ground wires 40, 41, and 42, respectively, from the electrical cord 31 are connected up to the receptacles 27 as illustrated in FIG. 4, with crimping and/or soldering at the terminals 28, 29, 30, respectively being provided. In order to ground the electrical components 27 to the metal casing, a short grounding wire 43 is provided, which is wrapped around or otherwise affixed to the ground wire 42 from the electrical cord 31, and then has a free end thereof passed through the opening 36 in the tab second end 35. Solder 45 may be provided to ensure the connection between the wire 43 and the tab 33 as desired.

Ready assembly of the cover 12 to the base 14 is provided according to the present invention by snap connection means formed integrally with the cover 12 and base 14. The portion of the snap connection means associated with the base 14 preferably comprises the openings 19 in the side edges 16. The portion of the snap connection means associated with the cover 12 comprises means defining a plurality of projections 50 in the side walls 23, which projections extend into the interior volume V and are in cooperative alignment with the openings 19.

Figure 6:
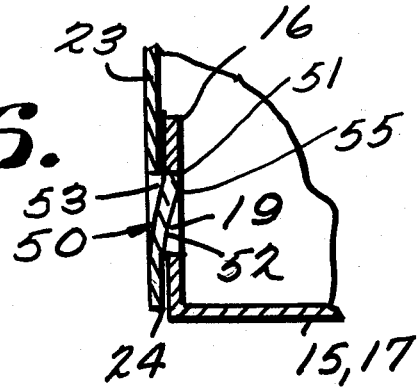
FIG. 6 is detail cross-sectional view of interengaging components of the cover and base of the casing of the multiple electrical outlet strip illustrated in FIG. 1.

The details of the interengagement between the components 12, 14 in the preferred embodiment are illustrated most clearly in FIG. 6. As can be seen, each projection 50 preferably comprises a single free edge portion 51 spaced from the respective side wall 23, and integral with the side wall 23 at all other points, a gradual slope (e.g. see sloping portions 52, 53) being provided from the side wall to the free edge portion 51 at all other edges of the projection 50. The projection 50 preferably is simply formed by using a cutting and deforming tool which deforms selected portions of the side walls 23. In FIG. 6 the projection 50 and opening 19 are shown spaced for clarity of illustration, however when the base 14 is inserted through the open bottom of the cover 12 the side edges 16 will engage the sloped portions 52 of the projections 50 and ride up them, being cammed inwardly slightly due to the relative spacing between the side edges 16 vis-a-vis the side walls 23. Once the upper edges 55 of the openings 19 pass the free projecting edges 51 of the projections 50, the side edges 16 will snap back toward the side walls 23, and a tight interfering engagement will be provided between the edges 50, 55, tightly holding the casing components together. Thus positive locking of the components together may be accomplished merely by effecting a relative linear movement between the pieces 12, 14. Yet, the base 14 can be removed from the cover 12 by sticking a hard tool between an edge 16 and side wall 23 and prying the edges 51, 55 out of interfering relationship.

When the casing pieces 12, 14 are assembled together, the ears 17 overlap the side walls 24, and the side edges 16 are completely received within the interior volume V. The temporary mounting openings 21 are also overlaid by the cover 12.

Figure 2:
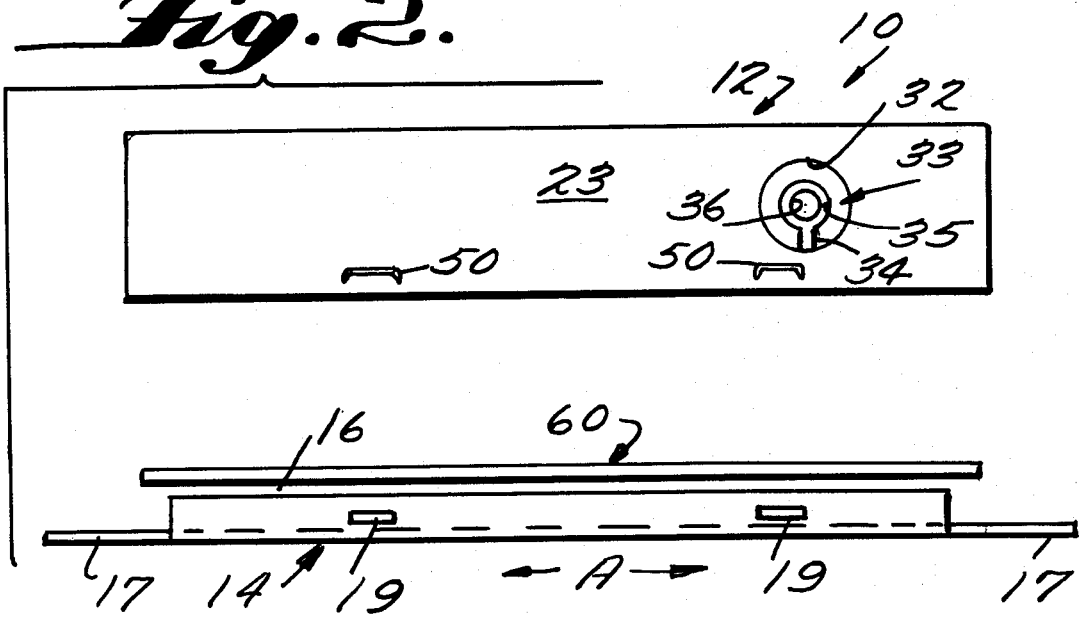
FIG. 2 is a side exploded view of the casing components of the multiple electrical outlet strip of FIG. 1.

In order to prevent penetration of a mounting projection, or other member, through the temporary mounting openings 21 into contact with the electrical components 27 mounted within the interior volume V, a stiff sheet of electrical insulating material, illustrated by reference numeral 60 in FIGS. 2 and 5, is disposed between the base 14 and the components 27. Preferably the sheet 60 is of plastic material, such as a LEXAN sheet 28–30 thousandths of an inch thick. Such a sheet preferably would have dimensions slightly greater than the cross-sectional dimensions of the cover 12 so that when inserted through the open bottom of the cover 12 it has an interference fit with the side walls 23, 24 and is held in place. No positive attachment to the cover 12 or base 14 is necessary. Such a sheet 60 provides an excellent barrier, while facilitating ease of assembly, being more appropriately utilizable than conventional fish paper which is sometimes used in cased electrical components.

As previously mentioned, the electrical components may comprise a wide variety of structures in addition to or in place of the outlet receptacles 27. For instance, as illustrated schematically at 62 in FIG. 1, circuit breakers may be provided in addition to the outlet receptacles 27.

CONSTRUCTION AND ASSEMBLY

An exemplary cased electrical component according to the invention having been described, an exemplary manner of construction and assembly thereof will now be set forth:

A blank metal cover 12 is formed, and the receptacle openings 26 are punched in the top face thereof, the cord-receiving opening 32 and the tab 33 are simultaneously formed in a side wall 23 thereof by punching, and the projections 50 are simultaneously formed in the side walls 23 by cutting and deforming the side walls 23 with a conventional tool. The flat base body 15 is formed, openings 19 are punched therein, and the side edges thereof are turned-up to form the upstanding side edges 16.

The electrical components 27 are then snapped into the openings 26, and the electrical cord 31 is pushed through the opening 32. The tab 33 is bent downwardly, toward the open bottom of the cover 12, to the position illustrated in FIG. 4. The wires 40, 41, 42 from the cord 31 are then put in proper electrical and mechanical engagement with the terminals 28, 29, 30 of the receptacles 27, and the grounding wire 43 is wrapped around ground wire 42, is passed through opening 36 in tab 33, and soldered in place with solder 45. The stiff LEXAN sheet 60 is then passed through the open bottom (see FIG. 4) of the cover 12 into interference engagement with the side walls 23, 24, and the side edges 16 of the base 14 are moved into the interior volume V, being cammed inwardly by the sloped walls 52 of projections 50, and then snapping into place, with the openings 19 receiving the free edges 51 of the projections 50.

The multiple electrical outlet strip 10 is then ready for use. The cord 31 is plugged into an electrical socket, and any number of other cords may be plugged into the receptacles 27.

It will thus be seen that according to the present invention a simple and inexpensive cased electrical component, and manner of construction and assembly thereof, have been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A cased electrical component comprising:

a metal casing;

an electrical component mounted within said metal casing;

an electrical cord leading into said casing from the exterior thereof and operatively connected to said electrical component; and means for simultaneously providing passage of said electrical cord through said casing and providing grounding of said electrical component to said casing, comprising: means defining a cord-receiving opening in said casing; tabe means for forming a ground; said tab means formed from a portion of said metal casing and extending into said cord-receiving opening from said means defining said opening, and bendable out of the way of said cord; and an electrical wire attached to said electrical component and to said tab means.

2. A component as recited in claim 1 wherein said tab means comprises a thinned body portion integral at a first end thereof with said casing, and having a second end, opposite said first end, that is free and enlarged; and means defining an opening in said enlarged second end for receipt of said wire attached to said electrical component.

3. A component as recited in claim 1 wherein said metal casing includes first and second separable pieces; said first piece comprising a base having a substantially planar elongated body portion of a width of approximately W, and a pair of side edges upstanding from opposite sides of said elongated body portion, and extending substantially parallel to each other, said side edges elongated in the same dimension of elongation as said body portion, and having an external spacing W therebetween; said second piece comprising an elongated cover having a plurality of side walls defining an internal volume therebetween, and an open bottom including first and second opposite elongated side walls substantially parallel to each other and having an internal spacing slightly greater than W; and snap connection means formed integrally with said first and second side walls and said first and second side edges for providing a snapping engagement interference fit between said base and said cover, said snap connection means comprising a plurality of distinct, widely spaced, structures associated with each of said first and second side walls.

4. A component as recited in claim 3 wherein said snap connection means comprises: means defining a plurality of substantially quadrate openings in each of said base first and second side edges; and means defining a plurality of projections integral with said cover side walls and extending outwardly from each of said first and second side walls, said projections in cooperative alignment with said side edge openings, and each of said projections comprising a single free edge portion spaced from its respective side wall, and integral with said cover side wall at all other points, a gradual sloping provided from said side walls to said free edge portion at all other edges of said projection, said single free edge portion being a most remote portion of said projection from said cover open bottom.

5. A component as recited in claim 3 further comprising means defining temporary mounting openings in said base within a portion of said base overlaid by said cover; and a stiff sheet of plastic electrically insulating material, unconnected to either said cover or said base, disposed between said electrical component and said base and overlying said temporary mounting openings so that a projection extending into said internal volume through said base will abut said sheet.

6. A method of assembling a cased electrical component from a metal casing having a cover with an open bottom, and a base for operative association with said cover to close said open bottom, comprising the steps of:

simultaneously punching an electrical cord-receiving opening and grounding tab in a wall of the cover, with the tab extending into the cord-receiving opening;

mounting the electrical component within the interior volume defined by the cover;

bending the tab out of the way so that an electrical cord can pass through the cord-receiving opening into the interior volume of the cover;

passing the cord through the opening into the inerior volume, and wiring the cord to the electrical component;

running a grounding wire from the electrical component to the tab, affixing the wire to both the electrical component and the tab; and closing the open bottom of the cover with the base.

7. A method as recited in claim 6 comprising the further steps of: forming interiorly-extending distinct, spaced projections in the side walls of the cover, and cooperating distinct, spaced openings in upstanding side edges of the base; and wherein said step of operatively covering the open bottom of the cover with the base is practiced by moving the side edges of the base into the open bottom of the cover until a snap engagement between the projections and openings is provided, tightly releasably locking the base in place.

8. A method as recited in claims 6 or 7 comprising the further steps of: forming temporary mounting openings in the base and portions thereof overlaid by the cover; and inserting a stiff electrical insulating material sheet through the open bottom of the cover, overlying the ground tab and the electrical component, before moving the base into engagement with the cover.

* * * * *